US005845379A

United States Patent [19]

Steffensen

[11] Patent Number: 5,845,379

[45] Date of Patent: Dec. 8, 1998

[54] METHOD FOR MAKING A SUPPORTING CROSSBAR CONSTRUCTION AND A CROSSBAR CONSTRUCTION MADE ACCORDING TO THE METHOD

[76] Inventor: Tage Steffensen, Basunvägen 19, S-435 41 Mölnlycke, Sweden

[21] Appl. No.: 104,070

[22] PCT Filed: Feb. 6, 1992

[86] PCT No.: PCT/SE92/00071

§ 371 Date: Oct. 14, 1993

§ 102(e) Date: Oct. 14, 1993

[87] PCT Pub. No.: WO92/13658

PCT Pub. Date: Aug. 20, 1992

[30] Foreign Application Priority Data

Feb. 8, 1991 [CH] Switzerland ..... 9100390

[51] Int. Cl.[6] ..... B21D 31/04; B21D 47/02; E04C 3/04

[52] U.S. Cl. ..... 29/6.1; 29/897.31; 29/897.35; 52/652.1; 52/670; 52/673

[58] Field of Search ..... 29/6.1, 897.3, 29/897.31, 897.35; 72/130, 230, 379.2; 52/652.1, 670, 673, 675

[56] References Cited

U.S. PATENT DOCUMENTS

| | | | |
|---|---|---|---|
| 2,990,038 | 6/1961 | Diamond | 29/897.3 |
| 3,034,197 | 5/1962 | Watanabe . | |
| 3,298,081 | 1/1967 | Terrell et al. . | |
| 3,763,616 | 10/1973 | Pastorelli et al. . | |
| 4,004,334 | 1/1977 | Greenley | 29/6.1 X |

FOREIGN PATENT DOCUMENTS

| | | | |
|---|---|---|---|
| 2 387 705 | 11/1978 | France | 29/897.35 |
| 390815 | 2/1924 | Germany | 29/897.35 |
| 2113756 | 10/1972 | Germany . | |
| 2121206 | 4/1975 | Germany . | |
| 668485 | 3/1952 | United Kingdom . | |
| 820876 | 9/1959 | United Kingdom . | |
| 2007119 | 5/1979 | United Kingdom . | |

*Primary Examiner*—S. Thomas Hughes
*Attorney, Agent, or Firm*—Young & Thompson

[57] ABSTRACT

A supporting crossbar construction is made from thin metal strip by feeding the strip lengthwise to a punching station, and forming in the punching station four parallel rows of slits extending lengthwise of the strip so that five parallel plate fields are formed extending lengthwise of the strip. The strip is then deformed so that the strip is expanded into a construction having two outer straight plate fields and a straight middle plate field between the two outer plate fields, the middle plate field being interconnected with each of the two outer plate fields by a plurality of diagonal members that are spaced apart and are formed by the deformation of the plate fields between the middle and outer plate fields, whereby the middle and outer plate fields are spaced a greater distance apart from each other. The middle plate field is then bent about at least one longitudinal bend line so as to bring together the two outer plate fields. The two outer plate fields are then secured together, thereby to form a supporting crossbar construction in which one flange is comprised by the middle plate field and another flange is comprised by the secured-together outer plate fields, there then being a plurality of alternately oppositely inclined crossbars interconnecting the flanges. The expanding is performed by forcing the middle and outer plate fields to follow diverging circular arcs of different radii of curvature, and then straightening them.

4 Claims, 12 Drawing Sheets

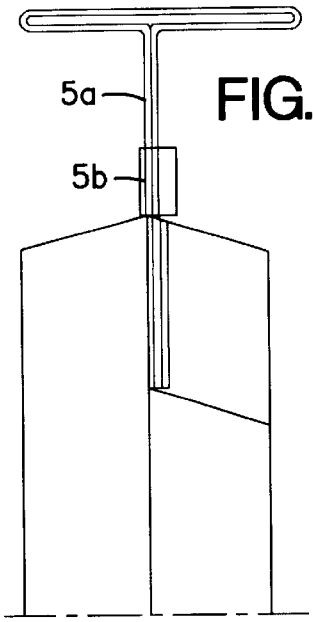
FIG. 5F
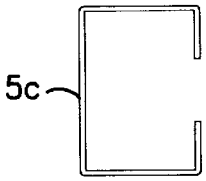
FIG. 5E
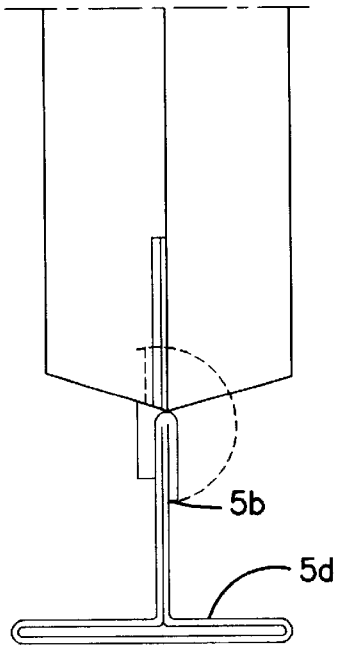
FIG. 5D
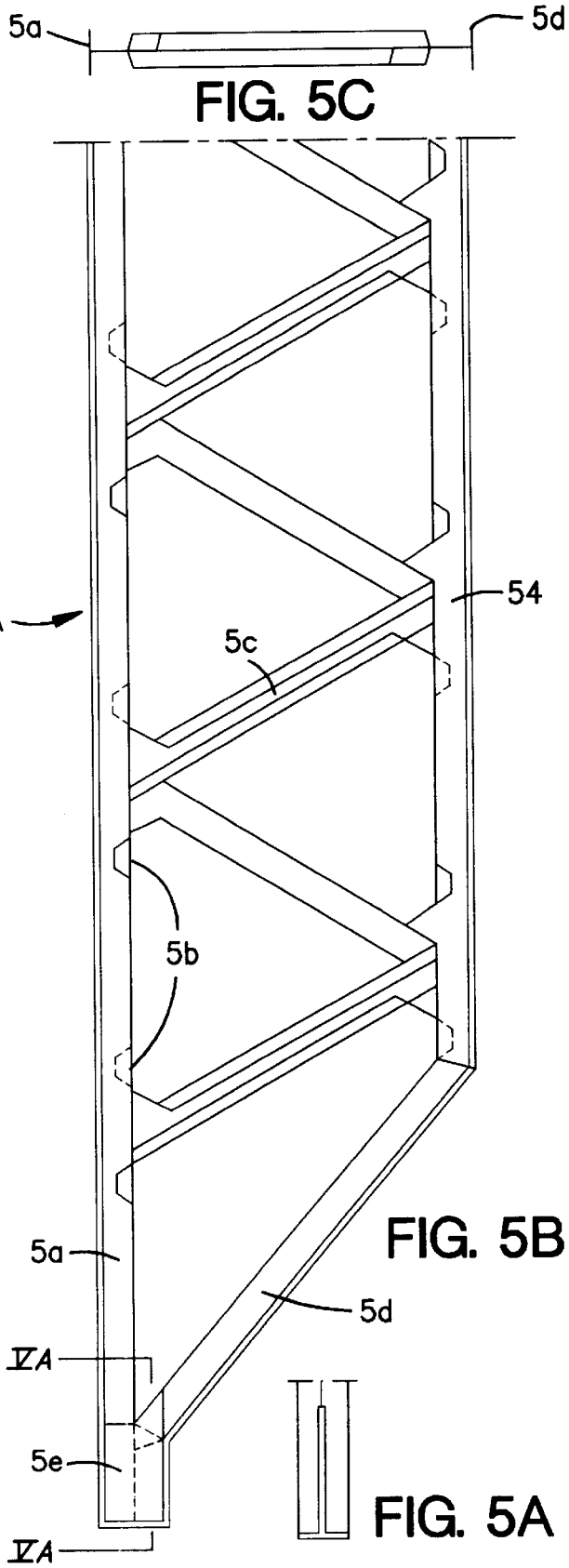
FIG. 5C
FIG. 5B
FIG. 5A (H–H of Figure 1)

(P–P (=O–O) of Figure 8)

METHOD FOR MAKING A SUPPORTING CROSSBAR CONSTRUCTION AND A CROSSBAR CONSTRUCTION MADE ACCORDING TO THE METHOD

FIELD OF THE INVENTION

The present invention relates to a method for making a supporting crossbar construction. More specifically the invention relates to a method for making a supporting crossbar construction of thin plate.

THE KNOWN PRIOR ART

U.S. Pat. No. 3,034,197 discloses a method for making crossbar constructions from a thin plate reel by cutting elongated slits in the longitudinal direction of the plate and then expanding the plate in the transverse direction.

U.S. Pat. No. 3,298,081 discloses a similar method for making crossbar constructions as U.S. Pat. No. 3,034,197, however in this case the cut platebars are bent outwards from the plane of the plate before expanding in the transverse direction.

A drawback of the methods according to both these patents is that the bearing strength is low when these constructions are used as crossbar beams.

Today's technology for supporting constructions of thin plate have the disadvantage that a substantial part of the plate material is not used for the supporting function. Attempts to punch out a light beam to a crossbar with a good supporting capacity means big material losses-and high costs.

All crossbar constructions of steel are today made by welding or with bolts. Welding destroys the galvanization and requires a costly subsequent treatment.

SUMMARY OF THE INVENTION

In accordance with the invention the supporting crossbar construction is made from thin plate on a reel, in a continuously running line with punching and roll-forming machines.

Crossbar beams provide a favorable distribution of the material mass into an upper and lower frame, and make a maximum use of the strength of the material.

An advantage of the present invention is that the height of the new crossbar construction easily can be changed. Greater beam height means better bearing strength without increasing the material consumption for the construction. This is an improvement as compared for instance to the previously known light beam.

Another advantage of the present invention is that the construction requires neither welding joints nor bolt joints.

Still another advantage of the present invention is that the fabrication requires no subsequent treatment. This is especially true when anti-corrosive treated thin plate is used.

Another advantage of the present invention is that very little wastage will be produced and material saving is high as compared to today's technology. Material costs are decisive for the economy in thin plate manufacturing, and in the manufacturing method according to the present invention relatively thin plate can be used due to a stiffening bending technique.

Due to an automated manufacturing method and low material usage according to the present invention, a highly competitive price for the product can be reached.

In the subsequent description three different embodiments of the present invention will be described, whereby three different products are produced, as follows:

a crossbar beam A for light constructions, a trapezoidal crossbar construction W suitable for joists or roof constructions, and a crossbar beam B for greater bearing distances.

The raw material used is preferably 0.8–2.5 mm steel plate, supplied on reels.

BRIEF DESCRIPTION OF THE DRAWINGS

The invention will now be described in detail with reference to the accompanying drawings.

FIG. 5A–5F disclose various views of a further product machining step in the production line of FIG. 1 for making a crossbar beam.

DETAILED DESCRIPTION OF THE PREFERRED EMBODIMENTS

Figure 1:
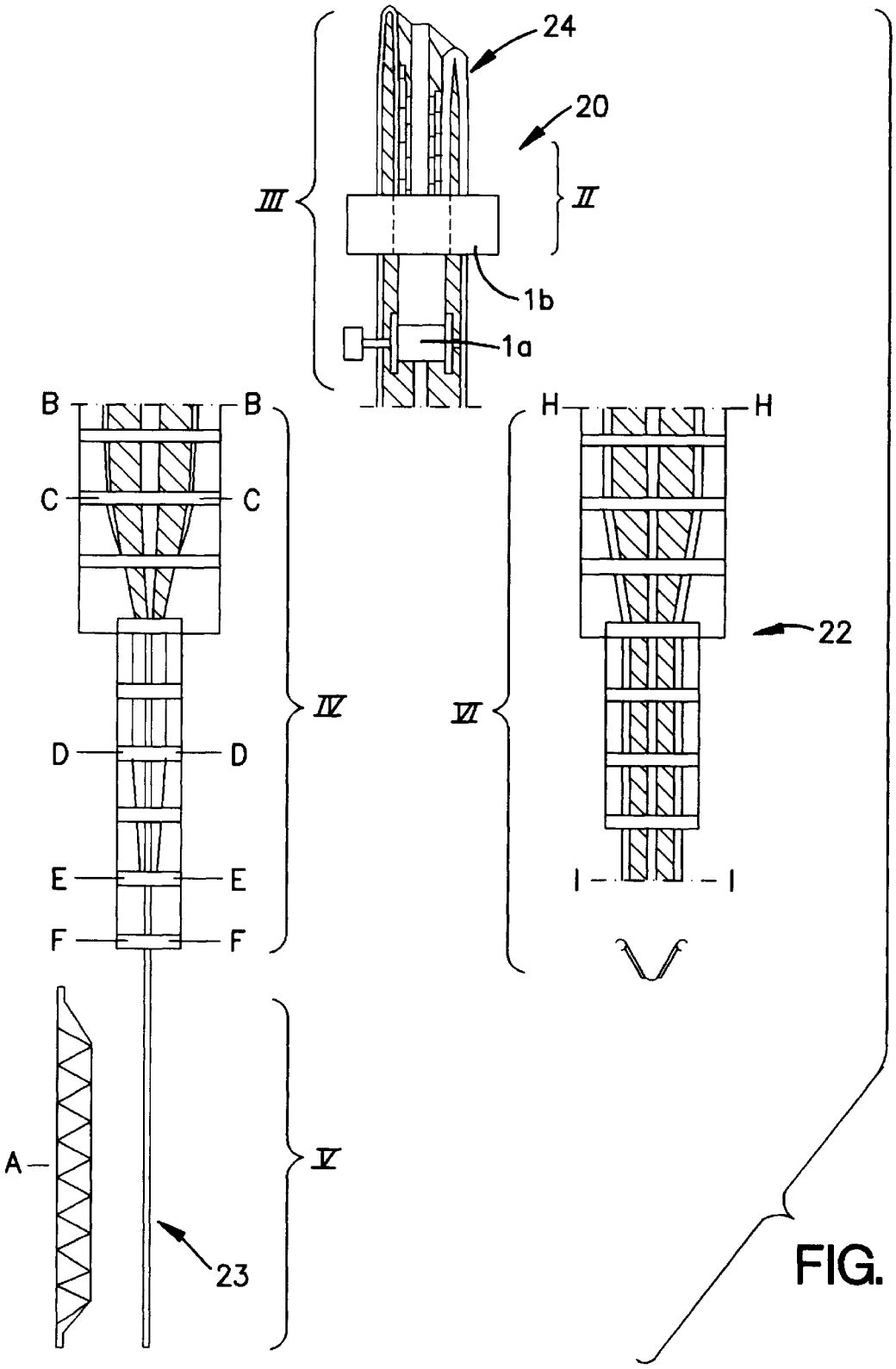
FIG. 1 discloses a production line for manufacturing of a crossbar beam for light construction and a trapezoidal crossbar construction and includes references to other figures which provide more detailed views of the features depicted.

FIG. 1 discloses an overview over a production line for making a crossbar beam A according to a first embodiment of the present invention and for making a trapezoidal crossbar construction W according to a second embodiment of the invention.

In a first part 20 of the production line the supply plate is fed directly from a coiling reel 1*a* through a punching station or a punching machine 1*b*, where the plate is punched and bent according to a given pattern. From the punching station

1*b* the machined plate is fed to a path 24 forming a circular arc. From the path 24 the plate is fed to a station 21 preferably comprising a roll-forming machine and further to a finishing station 23 to produce a crossbar beam A, as a final product.

The manufacturing of the trapezoidal crossbar construction W is started similarity as for the crossbar beam A, by feeding and punching the plate in the first part 20 of the production line. Then the plate is fed to a roll-forming station 22 and is thereafter worked into a finished product, to be described later.

Figure 2B:
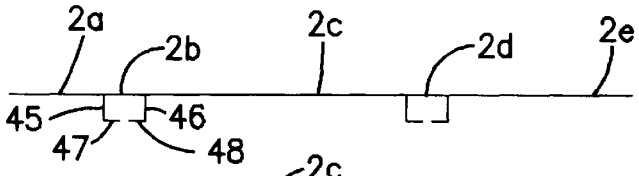
FIG. 2A–2B disclose various view of a punching station in the production line according to FIG. 1.
Figure 2A:
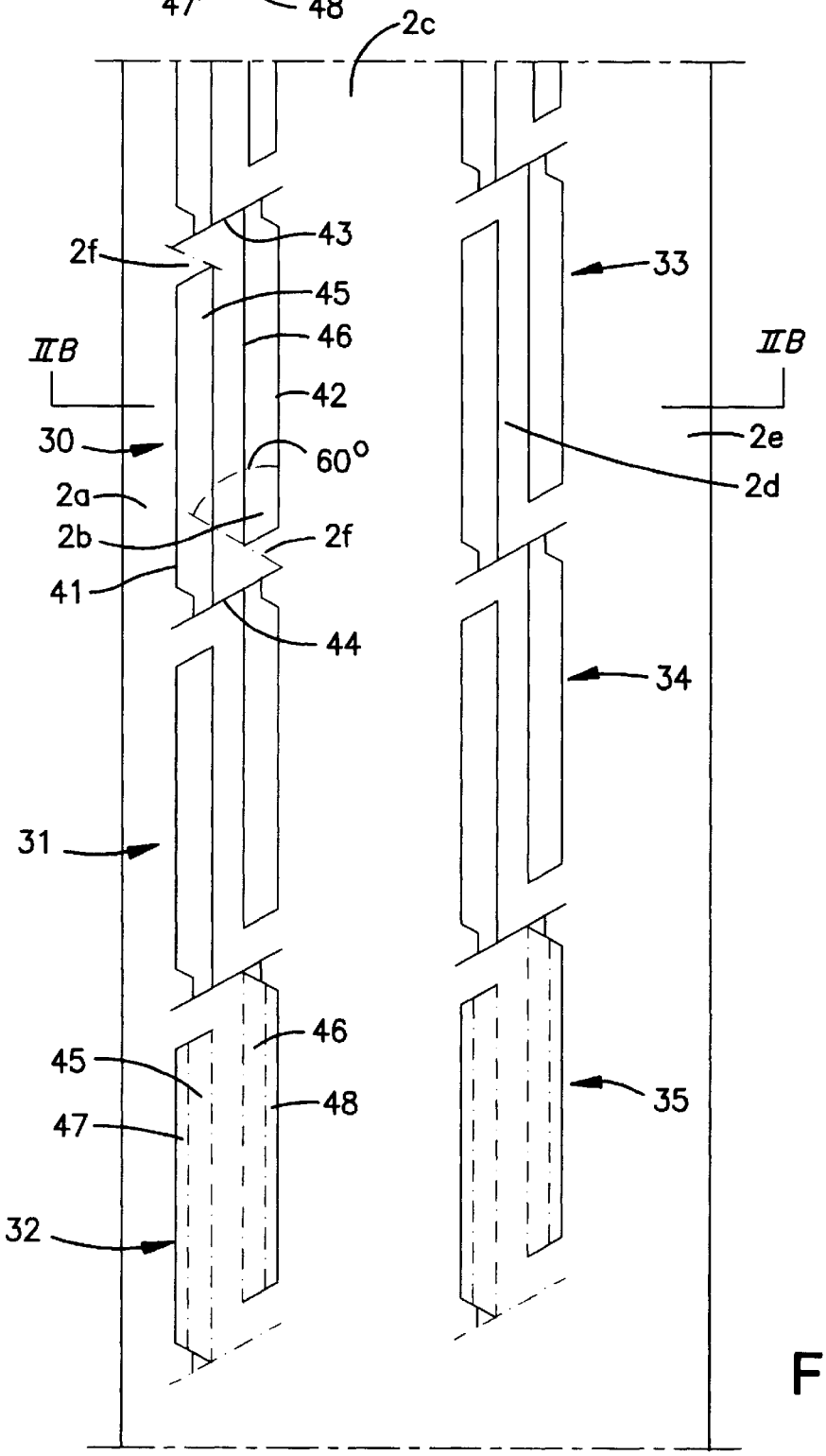
Figure 3A:
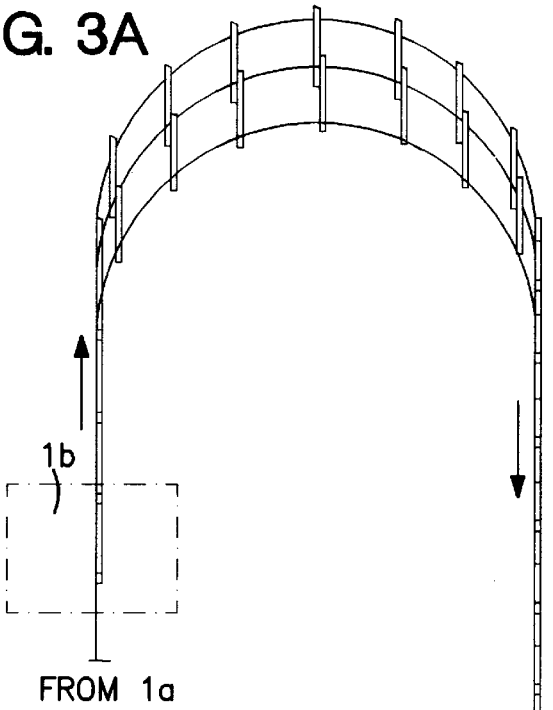
FIG. 3A–3D disclose various views of a station in the production line of FIG. 1 for bending the plate into a circular arc.
Figure 3B:
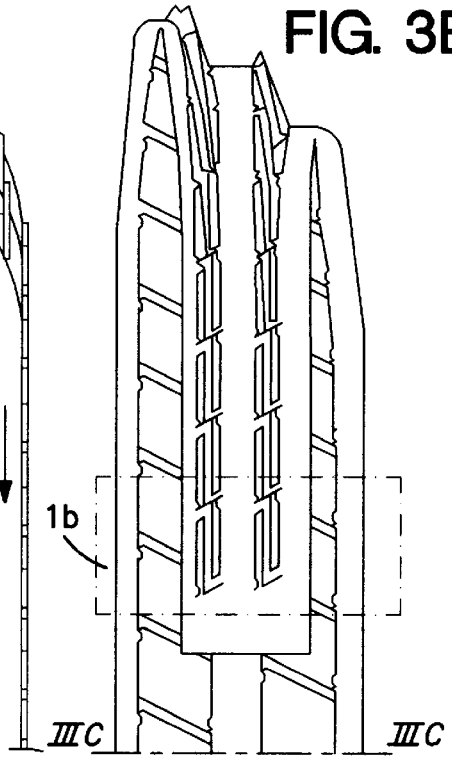
Figure 3C:
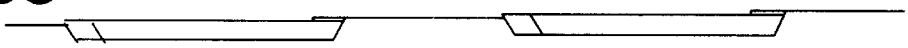
Figure 3D:
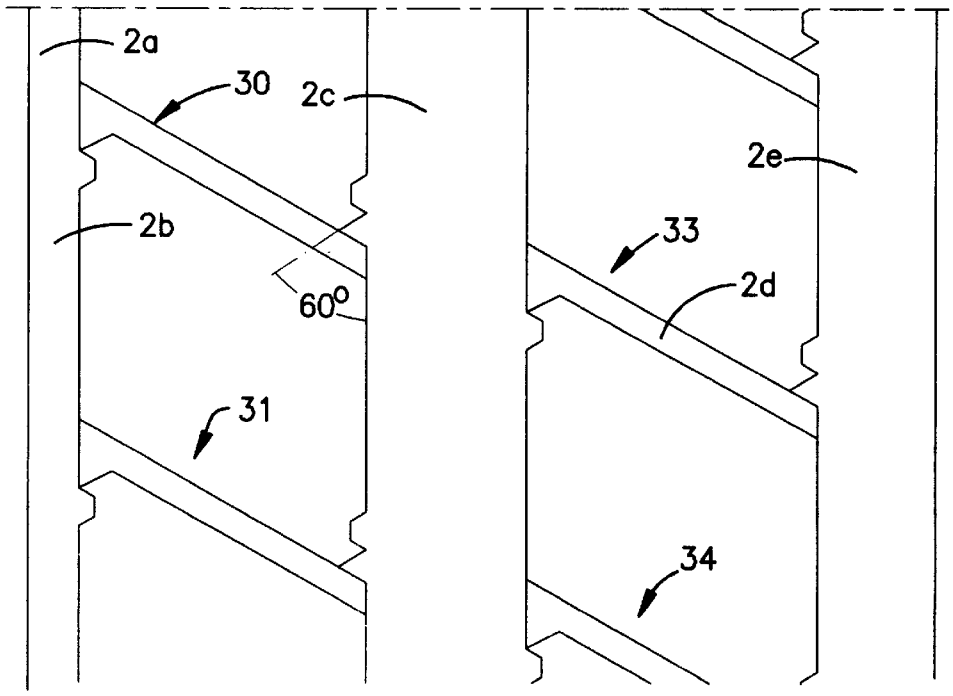
Figure 4D:
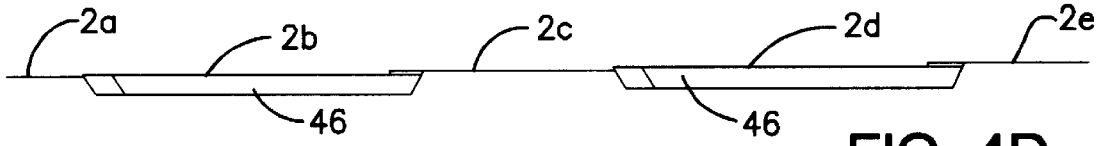
FIG. 4A–4D disclose various views of a first roll-forming station in the production line of FIG. 1 for making a crossbar beam.
Figure 4C:
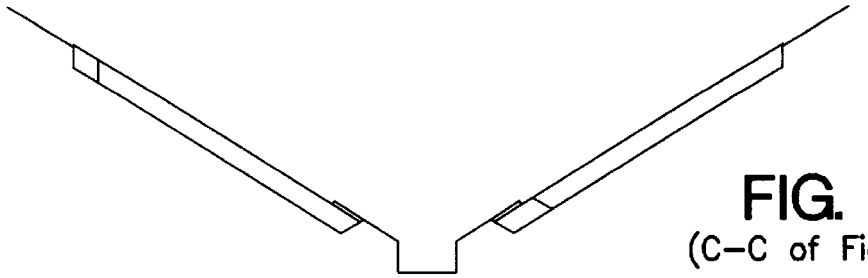
Figure 4B:
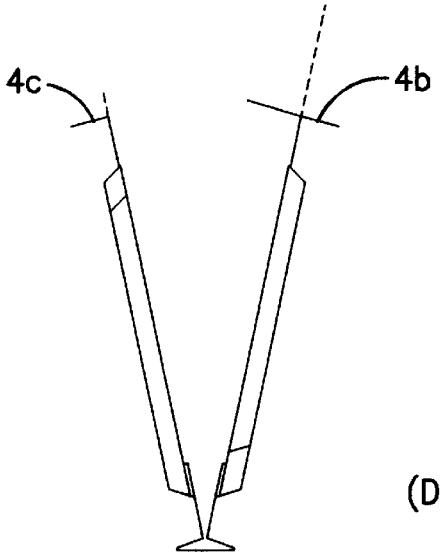
Figure 4A:
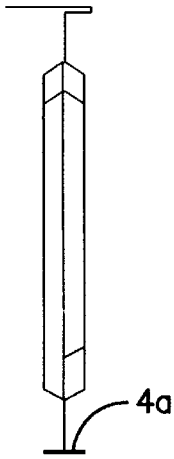

FIG. 2A–2B discloses the punching station 1*b* of FIG. 1, or more specifically the result of punching or cutting and bending the plate In the station. The apparatus for performing the punching and bending is, however not shown. This apparatus may be conventional and does not constitute a specific part of the present invention.

In accordance with FIG. 2A–2B a punching machine or a similar machine has punched or cut out five longitudinal plate fields 2*a*–2*e*. In the final product substantially the first and the fifth field 2*a*, 2*e* will form the upper frame, the third field 2*c* the lower frame and the second and fourth field 2*b*, 2*d* intermediate diagonal bars. FIG. 2 discloses three cut bars 30–32 in the second field 2*b* and three bars 33–35 in the fourth field 2*d*. A bar 30 is made by the punching machine punching or cutting two substantially parallel, longitudinal, line formed apertures or slits 41 and 42 and two inclined transverse slits 43 and 44. This is made such that the bar 30 has an unbroken plate connection via a lap 2*f*, at the upper slit 43, with the first field 2*a*, and via a similar lap 2*f*, at the lower slit 44, with the third field 2*c*. Then the bar edges 45–48 are bent into a substantially C-profile or similar shape in order to make the diagonal bars rigid. The ends of the longitudinal slits 41 and 42 are so shaped that the laps 2*f* get a suitable form. Preferably a line drawn between the upper end point of the slit 44 and the lower end point of the slit 42 will form an angle of 60 degrees with the longitudinal direction of the slit 42. Further, the lower transverse slit 44 of the diagonal bar 30 constitutes the upper transverse slit of the subsequent bar 31.

FIG. 3A–3D disclose in detail the circular path 24. As shown the plane plate fields 2*a*, 2*e* and 2*c* respectively for the upper and lower frames are curved in a circular arc of 180°. The diagonal bars 30–35, which are rigid due to their C-shaped profile, continue however in their horizontal state, and the joining plate laps 2*f* are therefore bowed 180° in a line with an angle of 60° towards the upper and lower frame. Section B—B 1:5 in the middle of FIG. 3 discloses the section B—B in the right half of the figure and the same section in FIG. 1.

FIG. 4 disclose the further passing of the plate material through the roll-forming station or machine 21. The two upper frame halves 2*a*, 2*e* and the parallel diagonal bars 2*b*, 2*d* are passed in an arc of 90° +90° to the same plane, however with an opposite. inclination for the diagonal bars 2*b* and 2*d* respectively. Simultaneously the upper frame plates 2*a* and 2*e* are bent into L-profiles 4*c* and 4*b*, and the lower frame plate 2*c* into a T-profile. The sections B—B to E—E correspond to the same sections in FIG. 1.

FIGS. 5A–5F disclose details formed in the finishing station 23. The L-profiles 4*b* and 4*c* are folded together into a T-profile 5*a*. The laps 5*b* are bent over adjacent plate flanges which are locked in this position. At the ends of the crossbar beam A the lower frame 5*d* is turned up towards the upper frame 5*a*. This turning angle defines the desired beam length. The surface of the turning point is reinforced with a plate 5*e*, which is screwed or bolted to the upper and lower frame. The result will be a statically stable crossbar A.

The beginning of the production line for making the trapezoidal crossbar construction W, in accordance with a second embodiment of the invention, comprises the same part 20 of the production line as for the crossbar beam A in the first embodiment shown in FIGS. 1–3.

Figure 6B:
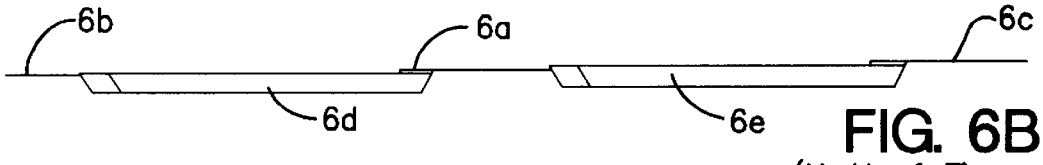
FIG. 6A–6B disclose various views of a first roll-forming station in the production line of FIG. 1 for making a trapezoidal crossbar construction.
Figure 6A:
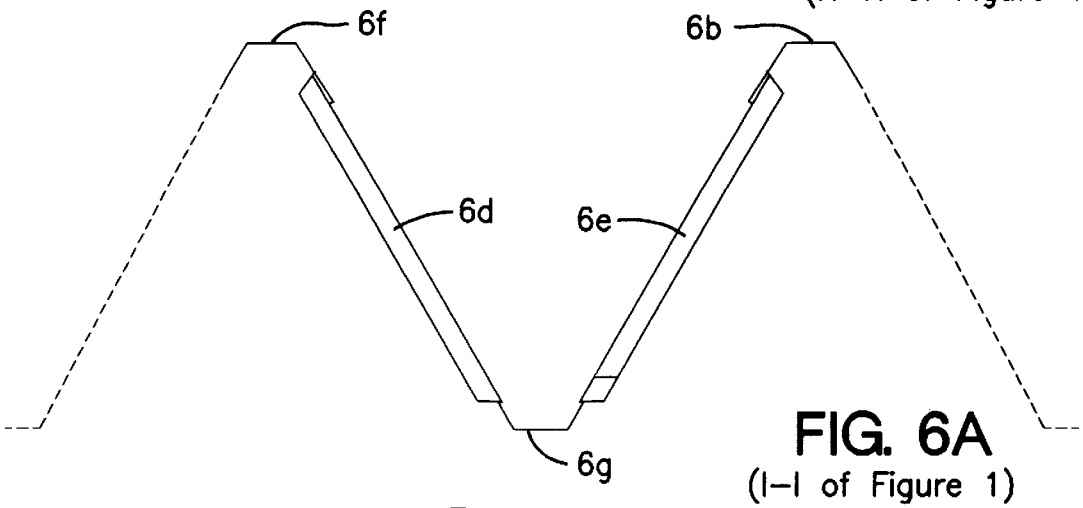
Figure 7C:
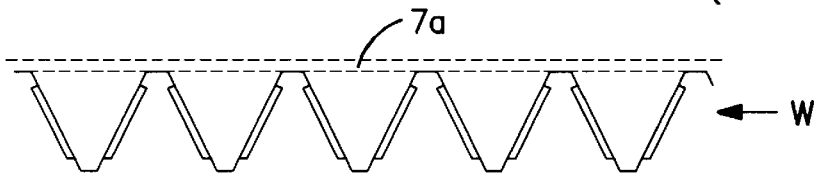
FIG. 7A–C7 disclose various views of assembling of several elements of FIG. 6 for making a trapezoidal crossbar construction.
Figure 7A:
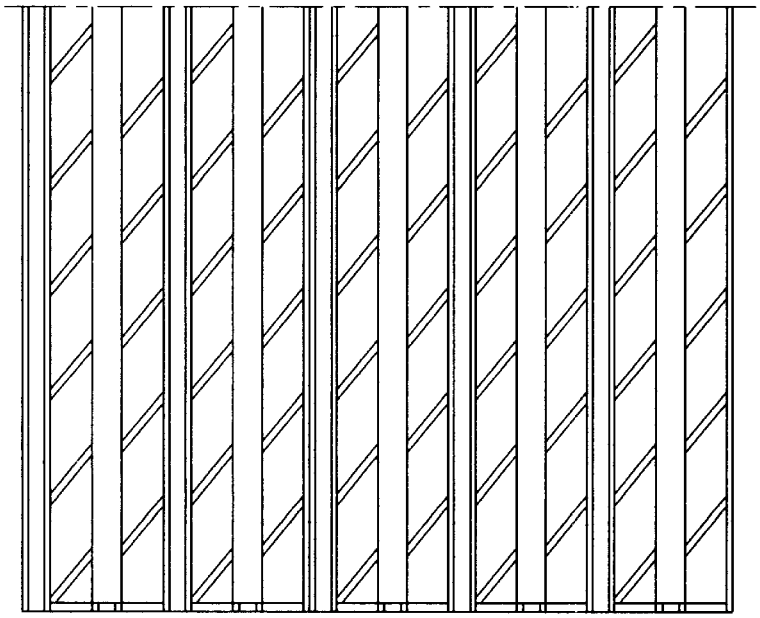
Figure 7B:
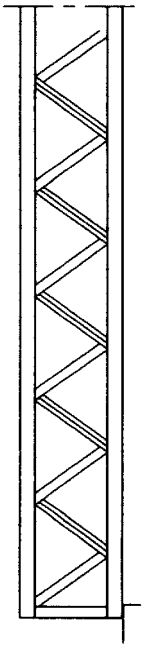

From the circular path 24 the plate material is fed to a roll-forming station 22 according to FIG. 1, whereby FIG. 6 discloses the input section H—H and output section I—I for the plate material. In this roll-forming station the lower frame 6*a* and the two upper frame halves 6*b*, 6*c* are bent into U-profiles 6*f*, 6*g*, 6*h* with the diagonal bars 6*d*, 6*e* having an inclination of about 60°. Hereby a trapezoidal cross section is formed in which the inclination for the diagonal bars 6*d* and 6*e* are opposite in view of the frames 6*f*, 6*h*, 6*g*. A plurality of such elements can be assembled by bolting or screwing together the upper frames as shown in FIG. 7A–7C, forming a stable crossbar construction W. The forces in the cross direction of the construction are transferred to steady fastening points or are stabilized by a crossbar or disk material 7*a*, fastened to the upper frames.

Figure 8:
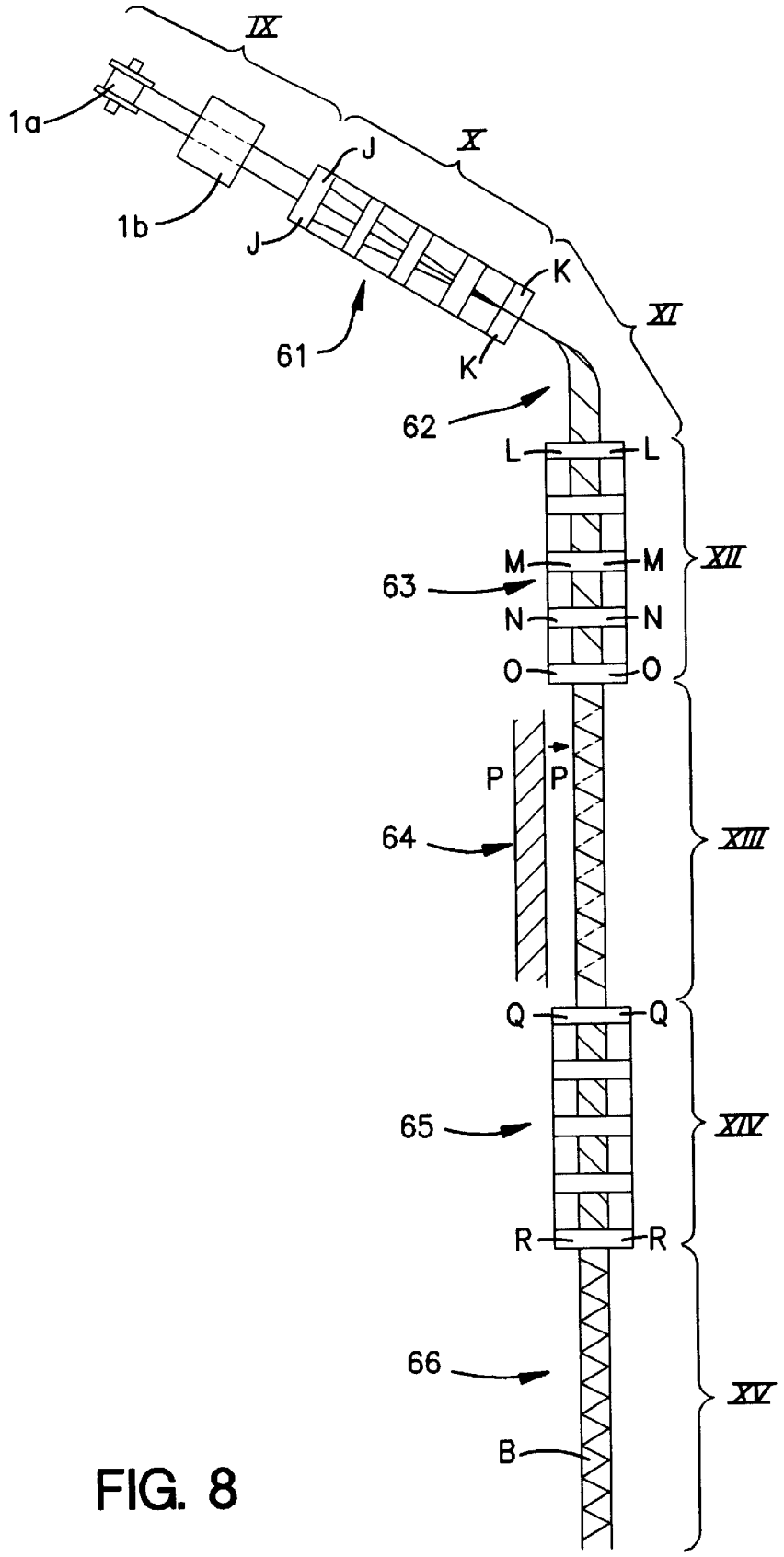
FIG. 8 discloses a production line for making a crossbar beam for greater bearing distances and include references to other figures which provide more detailed views of the features depicted.

FIG. 8 discloses an overview over a production line for making a crossbar beam B for greater bearing distances, in accordance with a third embodiment of the invention. Directly from a coiling reel 1*a* the plate is fed through a combined punching and bending station 1*b* to a roll-forming station 61, further to a station 62 for bowing the plate into a circular arc and then to another roll-forming station 63. From this station the plate is fed to a turning station 64, then to a further roll-forming station 65, and thereafter to a station for further machining in order to produce the final product B.

Figure 9:
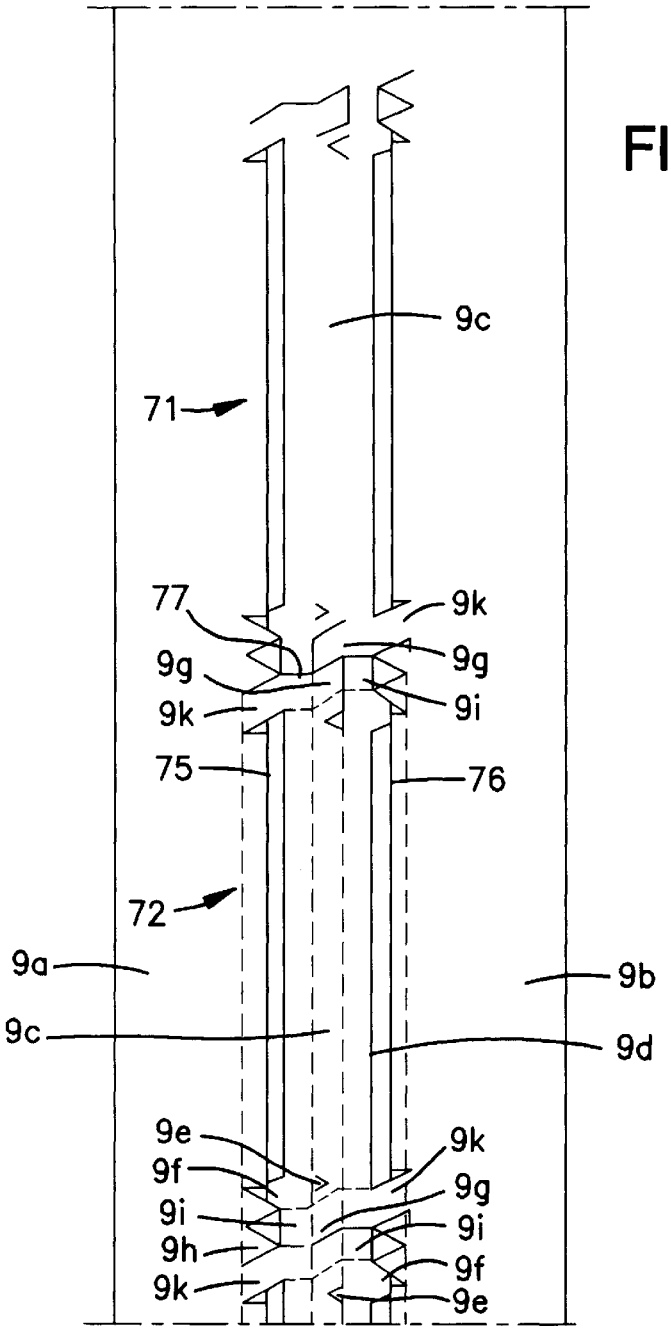
FIG. 9 discloses a punching station in the production line of FIG. 8.

FIG. 9 discloses in detail the result of the punching and bending operations performed in the punching station 1*b* in FIG. 8 The punching machine has punched or cut longitudinal slits 75 and 76 which divide the plate into three longitudinal plate fields 9*a*, 9*b*, 9*c*. The fields 9*a* and 9*b* will form the upper and lower frames whereas the field 9*c* will form the diagonal bars, of which a first bar 71 and a second bar 72 is shown in the figure. A substantially transverse slit 77 separates bars 71 and 72 from each other. Each bar has an unbroken plate connection to the adjacent plate fields via an upper and a lower lap 9*k*, equal to the laps 2*f* in FIG. 2. The short bar side flanges 9*d* and a number of auxiliary laps 9*e*–9*i* are bent into a suitable angle, as shown in FIG. 9–11 and FIG. 15.

Figure 10:
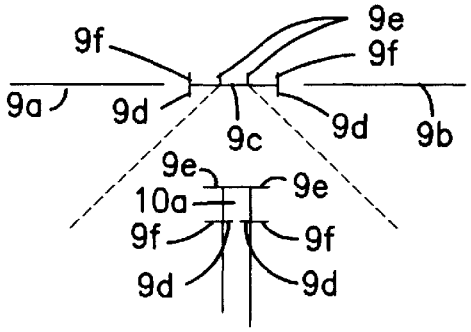
FIG. 10 discloses a first roll-forming station in the production line of FIG. 8.

FIG. 10 discloses the result of the plate material passing the roll-forming machine 61. The diagonal bars are bent into a square C-profile 10*a* simultaneously with the turnover of the plate fields 9*a* and 9*b* about 90° into two parallel planes.

Figures 11A, 11B:
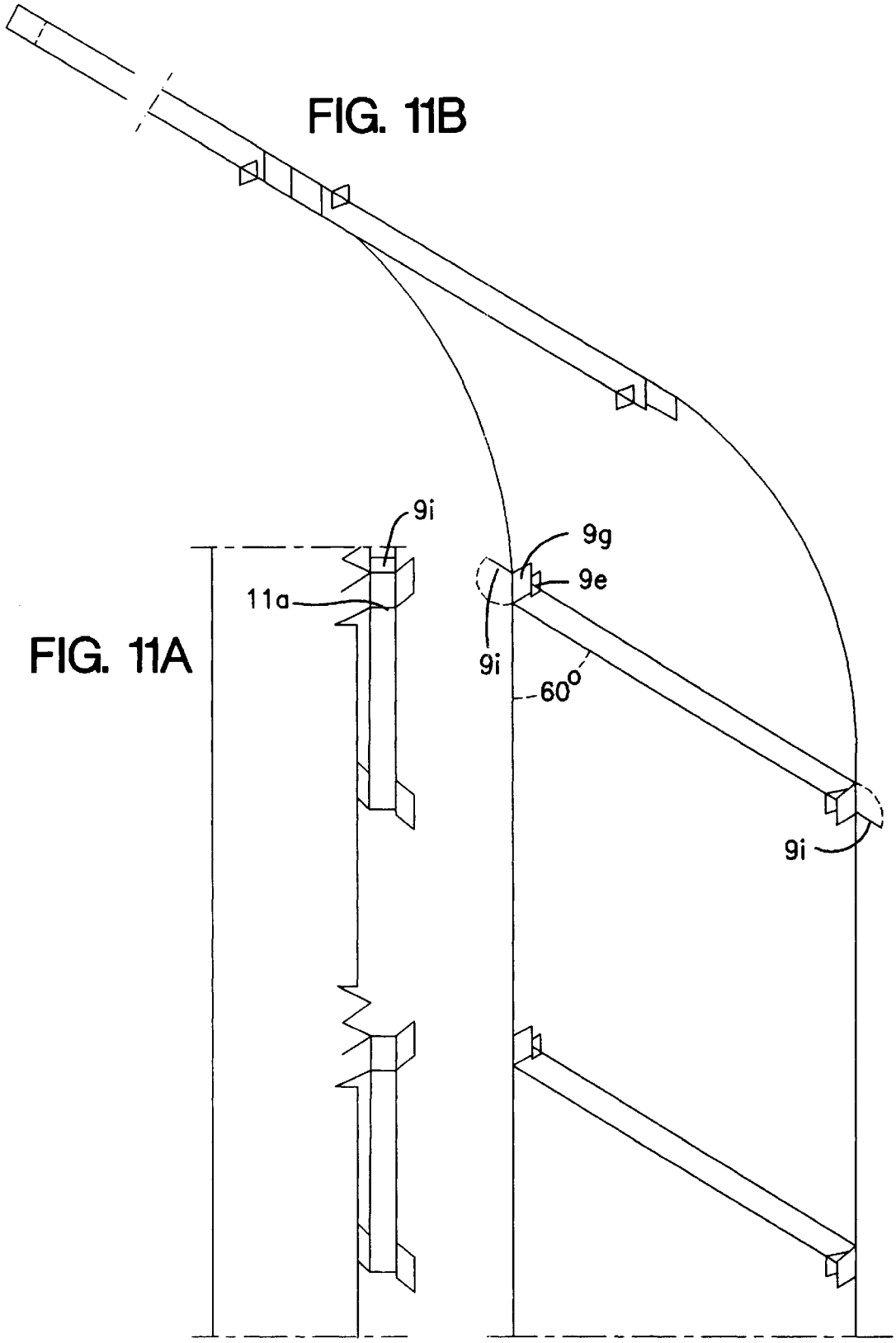
FIG. 11A–11B disclose various views of a station in the production line of FIG. 8 for bending the plate into a circular arc.
Figure 12E:
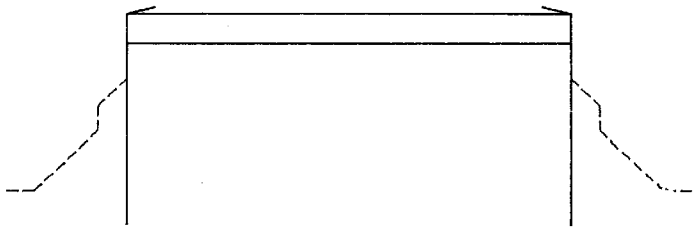
FIG. 12A–12E disclose various views of a second roll-forming station in the production line of FIG. 8.
Figure 12D:
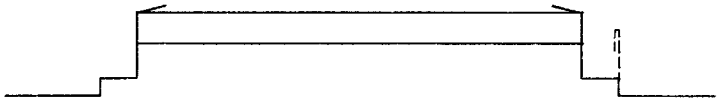
Figure 12C:
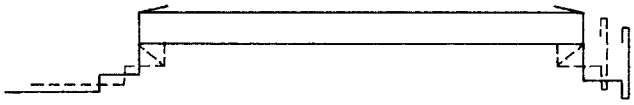
Figure 12B:
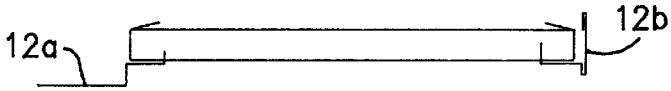
Figure 12A:
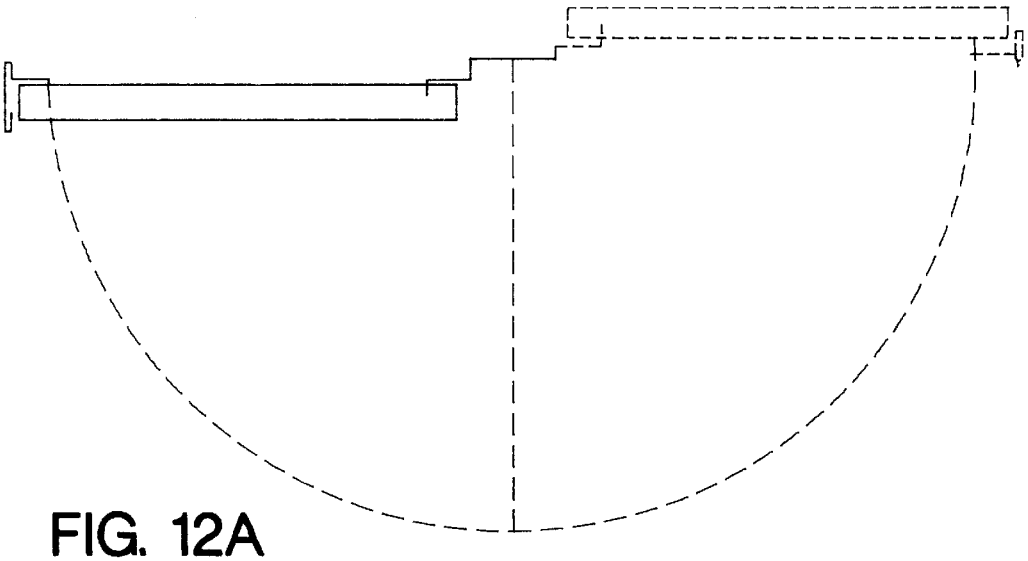

FIG. 11A–11B disclose the feeding of the plate in the substantially circular path 62, see FIG. 8, so that the angle between the incident line and the outgoing line is about 60°. The diagonal bars 71, 72, which are rigid due to their tube formed cross section, follow the original direction of the line. The connecting plate lap 9*k* is bent 60°. The end laps 9*i* are bent over the lap 11*a* to lock the diagonal bars in this position.

FIGS. 12A–12E disclose the plate material path in the new direction through the second roll-forming station 63. The upper and the lower frames are bent into L-profiles 12*a*, 12*b* in the various stages, sections L—L, M—M, N—N and O—O.

Figure 13:
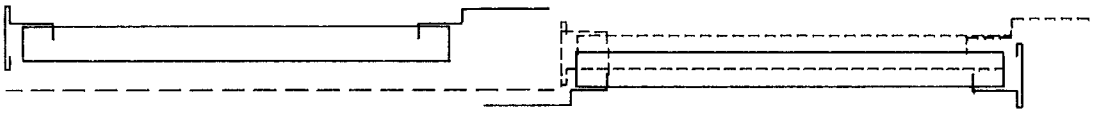
FIG. 13 discloses a turning station in the production line of FIG. 8.
Figure 14B:
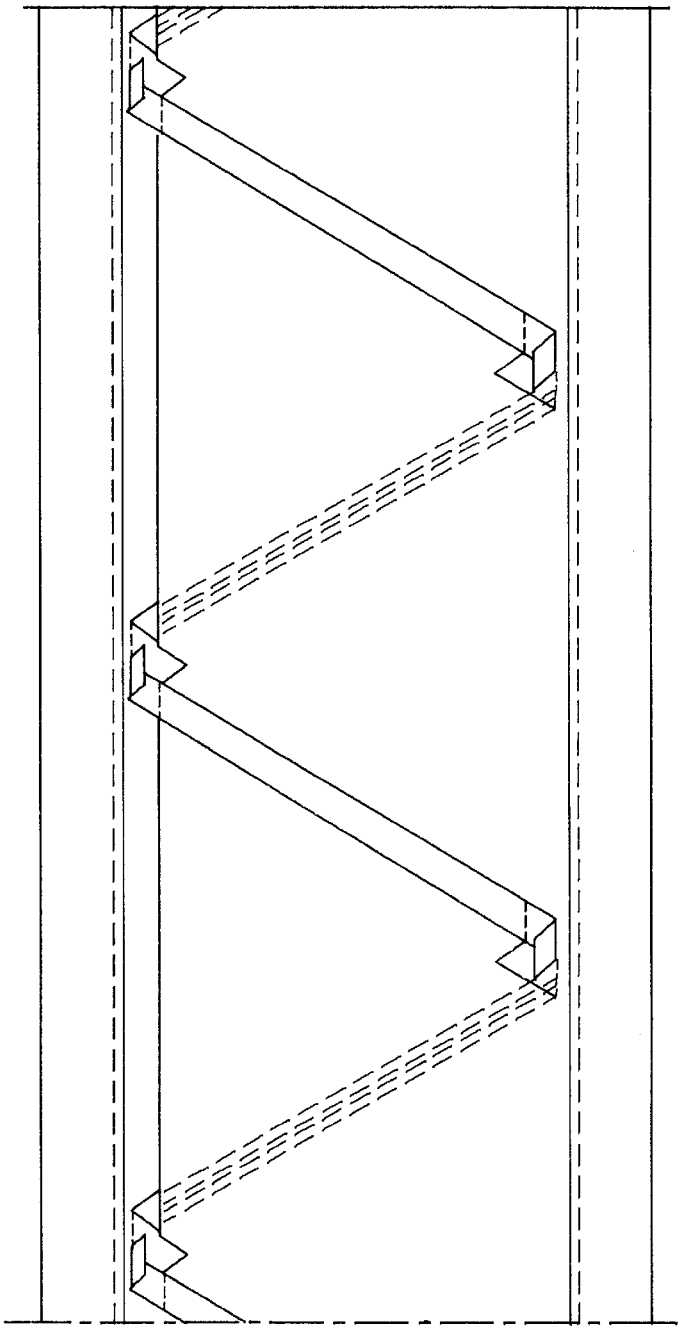
FIG. 14A–14B disclose various views of still another roll-forming station in the production line of FIG. 8.
Figure 14A:
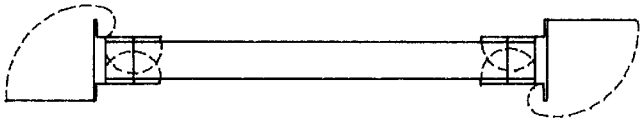
Figure 15C:
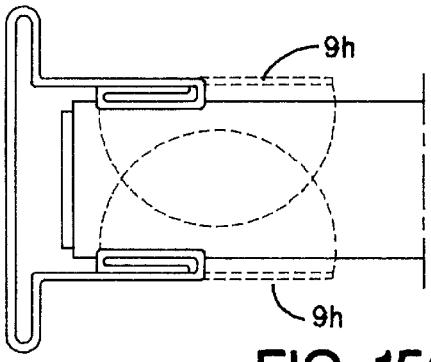
FIGS. 15A–15F disclose various views of a further production step in the product line of FIG. 8 for producing a crossbar beam for greater bearing distances.
Figure 15B:
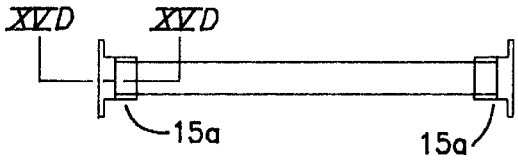
Figure 15D:
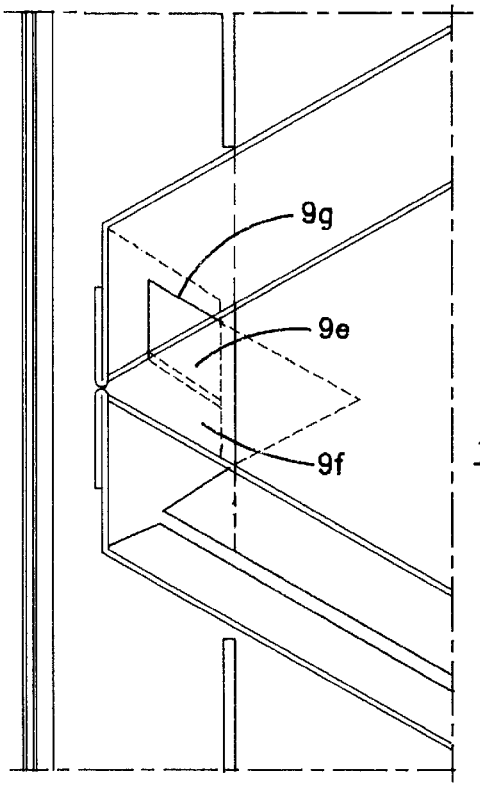
Figure 15A:
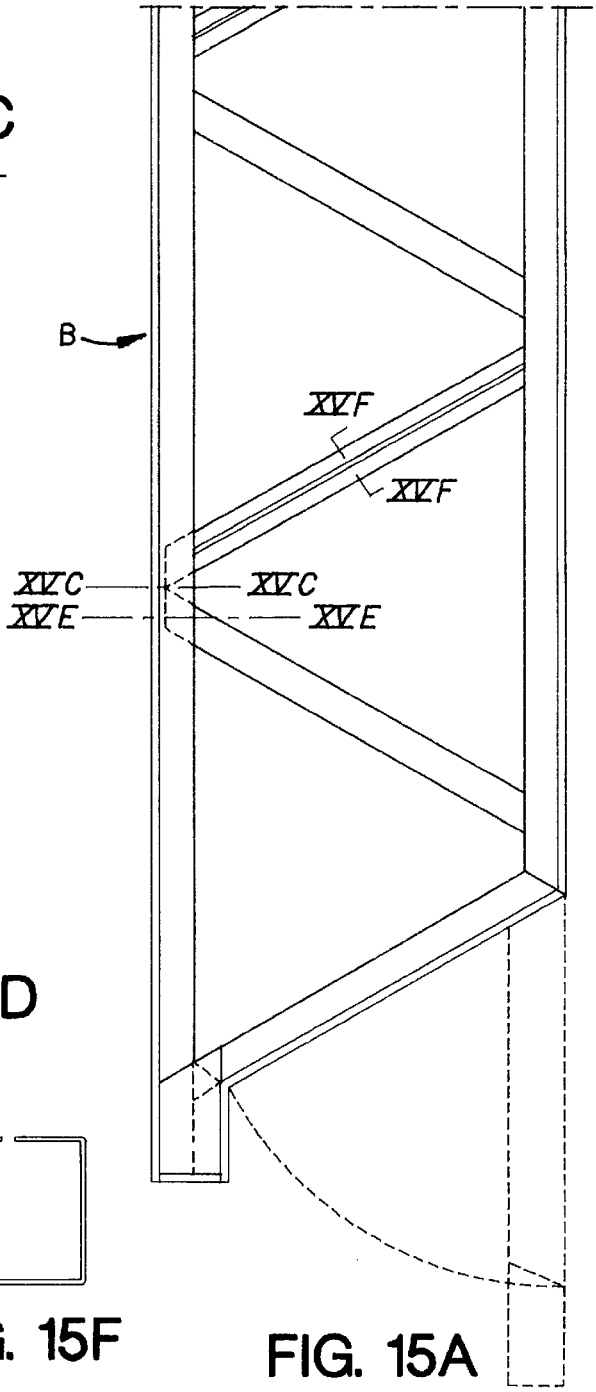
Figure 15E:
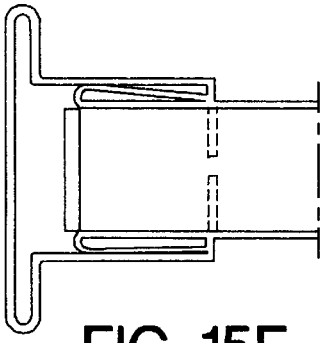
Figure 15F:
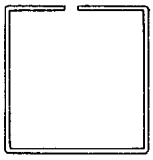

When the first half of the beam has left the roll-forming station, it is turned 180° in the turning station 64, FIG. 13, and the diagonal bars are then given an inclination in the opposite direction. Simultaneously the second beam half is rolling in from the roll-forming station and is joined with the first half, section P—P. By means of roll-forming in the roll-forming station 65, FIG. 14A–14B and FIGS. 15A–15F, the two halves are folded together into tube profiles with T-flanges, section S—S, T—T and U—U. Finishing of the ends is performed in the end station 66 in a same way as for the crossbar beam A, whereby a crossbar beam B for greater bearing distances is produced as an end product.

I claim:

1. A method for making a supporting crossbar construction from metal strip, comprising the steps of:

feeding the strip lengthwise to a punching station;

forming in said punching station four parallel rows of slits extending lengthwise of the strip so that five parallel plate fields are formed extending lengthwise of the strip, said five plate fields being defined by said four rows of slits;

forming in said punching station pairs of inclined slits transverse to a pair of the rows of slits, each pair of the inclined slits and the pair of the rows of slits therebetween defining a diagonal member;

deforming each diagonal member into a tubular or C-shaped profile;

deforming the strip so that the strip is expanded into a construction having two outer straight plate fields and a straight middle plate field between said two outer plate fields, said middle plate field being interconnected with each of said two outer plate fields by a plurality of the diagonal members that are spaced apart and are formed by deformation of the plate fields between said middle and outer plate fields, whereby said middle and outer plate fields are spaced apart from each other; and bending said middle plate field along at least one bend line extending lengthwise of the strip so as to bring together said two outer plate fields and securing said two outer plate fields together, thereby to form a supporting crossbar construction in which one flange is comprised by said middle plate field and another flange is comprised by said secured-together outer plate fields, the diagonal members being a plurality of alternatively oppositely inclined crossbars interconnecting said flanges.

2. A method as claimed in claim 1, wherein said expanding is performed by forcing said middle and outer plate fields to follow diverging circular arcs of different radii of curvature.

3. A method for making a supporting cross bar construction from metal strip, comprising the steps of:

feeding a metal strip to a punching station;

forming in said punching station two parallel lines of slits in said strip that extend lengthwise of said strip thereby to form three contiguous plate fields comprising two outer plate fields on opposite sides of a central plate field;

forming in said punching station pairs of inclined slits transverse to a pair of the lines of slits, each pair of the inclined slits and the pair of the lines of slits therebetween defining a diagonal member;

deforming each diagonal member into a tubular or C-shaped profile;

forcing said two outer plate fields to follow diverging circular paths of different radii of curvature; and thereafter straightening the two outer plate fields, thereby to form a supporting crossbar construction having said two outer plate fields extending lengthwise of the strip and interconnected by a plurality of the diagonal members that are spaced diagonal crossbars that are parallel to each other and that form acute angles with said two outer plate fields.

4. Crossbar construction comprising two elongated outer plate fields and a middle plate field, each outer plate field being connected to the middle field by a plurality of crossbars, the crossbars secured to each said outer plate field being parallel to each other, said two outer plate fields being secured together and said middle plate field being bent along at least one bend line extending lengthwise of the middle plate field so that the crossbars secured to one said outer plate field overlie and are oppositely inclined to the crossbars secured to the other said outer plate field.

* * * * *

UNITED STATES PATENT AND TRADEMARK OFFICE

CERTIFICATE OF CORRECTION

PATENT NO. : 5,845,379

DATED : December 8, 1998

INVENTOR(S) : Tage STEFFENSEN

It is certified that error appears in the above-indentified patent and that said Letters Patent is hereby corrected as shown below:

On the title page, Item [30], change "[CH] Switzerland" to --[SE] Sweden--.

Signed and Sealed this

Twenty-fifth Day of May, 1999

*Attest:*

Q. TODD DICKINSON

*Attesting Officer*

*Acting Commissioner of Patents and Trademarks*